United States Patent [19]

Licari

[11] 4,429,638

[45] Feb. 7, 1984

[54] UTILITY SHELF

[75] Inventor: Yaffa Licari, Elberon, N.J.

[73] Assignee: Basic Line, Inc., Cliffwood Beach, N.J.

[21] Appl. No.: 339,428

[22] Filed: Jan. 15, 1982

[51] Int. Cl.[3] ..... A47B 85/00; A47B 3/00; A47B 67/02; A47F 5/08

[52] U.S. Cl. ..... 108/25; 108/28; 108/33; 108/91; 312/245; 211/89

[58] Field of Search ..... 108/25, 33, 28, 29, 108/91, 152; 312/245, 290; 211/89; 220/339; 229/33, 36, 44 R

[56] References Cited

U.S. PATENT DOCUMENTS

| | | | |
|---|---|---|---|
| 184,904 | 11/1876 | Rallo | 312/245 |
| D. 187,636 | 4/1960 | Nagel . | |
| D. 226,156 | 1/1973 | Fitzgibbon | 6/91 |
| 601,550 | 3/1898 | Broughton . | |
| 658,880 | 10/1900 | Tandy . | |
| 824,150 | 6/1906 | Chamas . | |
| 886,534 | 5/1908 | Myers . | |
| 1,090,724 | 3/1914 | Koehler . | |
| 1,530,793 | 3/1925 | Stephens | 312/245 X |
| 1,549,142 | 8/1925 | McKenzie et al. . | |
| 1,551,434 | 8/1925 | Shiffer . | |
| 1,557,989 | 10/1925 | Dombrowsky . | |
| 1,559,398 | 10/1925 | Anderson . | |
| 1,569,459 | 1/1926 | Colbert et al. . | |
| 1,657,049 | 1/1928 | Van Sicklen, Jr. | 312/245 X |
| 1,680,668 | 8/1928 | Boer | 312/245 X |
| 1,831,509 | 11/1931 | Rinehardt . | |
| 1,891,463 | 12/1932 | Yock | 211/89 |
| 2,239,881 | 4/1941 | Davis . | |
| 2,578,775 | 12/1951 | Belsinger | 229/27 |
| 2,613,000 | 10/1952 | Moore . | |
| 2,793,762 | 5/1957 | Broussard . | |
| 2,929,513 | 3/1960 | Herzberg . | |
| 2,957,584 | 10/1960 | Jenkins . | |
| 3,447,199 | 6/1969 | Trimble | 220/339 X |
| 3,458,113 | 4/1968 | Swartzbaugh | 220/339 X |
| 4,074,635 | 2/1978 | Stauble . | |
| 4,181,382 | 1/1980 | Harvey . | |

FOREIGN PATENT DOCUMENTS

| | | |
|---|---|---|
| 1454706 | 11/1976 | United Kingdom . |

*Primary Examiner*—William E. Lyddane
*Assistant Examiner*—Peter R. Brown
*Attorney, Agent, or Firm*—Lerner, David, Littenberg, Krumholz & Mentlik

[57] ABSTRACT

A utility shelf has a body which is provided with an enclosed storage well so that articles, such as combs and brushes, may be stored in the storage well in an upright position. The storage well is formed from a hinged panel which can be pivoted out of the body of the shelf, so that the entire back of the shelf is open to permit another identical shelf to be nested within it. The shelf is also provided with a gripping device for releasably gripping articles, such as towels.

10 Claims, 5 Drawing Figures

UTILITY SHELF

FIELD OF THE INVENTION

The present invention relates to utility shelves, and, more particularly, to such shelves which are especially adapted to be mounted from a wall or a similar support surface.

BACKGROUND OF THE INVENTION

In U.S. Pat. No. 4,074,635 there is disclosed a unitarily constructed plastic shelf which can be nested in a similar shelf to facilitate storage and shipping. The shelf has a flat horizontal support surface on which objects can be stored. Because only certain types of objects can be stored on the horizontal support wall and the shelf is not equipped with any other storage facility, the shelf has limited utility.

SUMMARY OF THE INVENTION

The present invention relates to a new and improved utility shelf which is adapted to store a variety of different articles. For instance, the shelf can be provided with a storage well adapted to hold articles, such as combs and brushes, in an upright position. Also, hangers may be provided on the shelf for hanging various objects, such as key chains and articles of clothing.

In one embodiment, the shelf includes a body defined by a flat top wall, a curved front wall and a pair of converging and diverging sidewalls. An opening in the top wall provides access to an internal storage well positioned within the body of the shelf. A panel is hingedly connected to the body of the shelf such that the panel is pivotable between a closed position in which the panel extends into the body to form a rear wall and an inner sidewall of the storage well and an open position in which the panel is positioned outside the body to provide substantially complete access to the body from behind. When the panel is in its open position, the shelf may be nested in another similar shelf to facilitate shipping and display of the shelves. The panel can be formed integrally with the body to provide a unitary structure, thereby facilitating assembly of the shelf. The panel can be divided into two sections by a live hinge formed integrally with the panel. One section of the panel forms the rear wall of the storage well, while the other section forms the inner sidewall of the storage well.

The front wall of the shelf may be provided with a gripping device for releasably gripping objects, such as towels. The gripping device includes an opening formed in the front wall of the body and a flap associated with the opening. The flap is hingedly connected to the front wall such that the flap is pivotable between a non-gripping position in which the flap extends outwardly from the front wall and a gripping position in which the flap extends inwardly from the front wall. The flap is urged towards its non-gripping position, whereby the flap pinches an article inserted through the opening against the front wall of the body when the flap is in its gripping position.

BRIEF DESCRIPTION OF THE DRAWINGS

For a more complete understanding of the present invention, reference may be had to the following detailed description of an exemplary embodiment considered in conjunction with the accompanying drawings, in which.

DESCRIPTION OF AN EXEMPLARY EMBODIMENT

Figure 1:
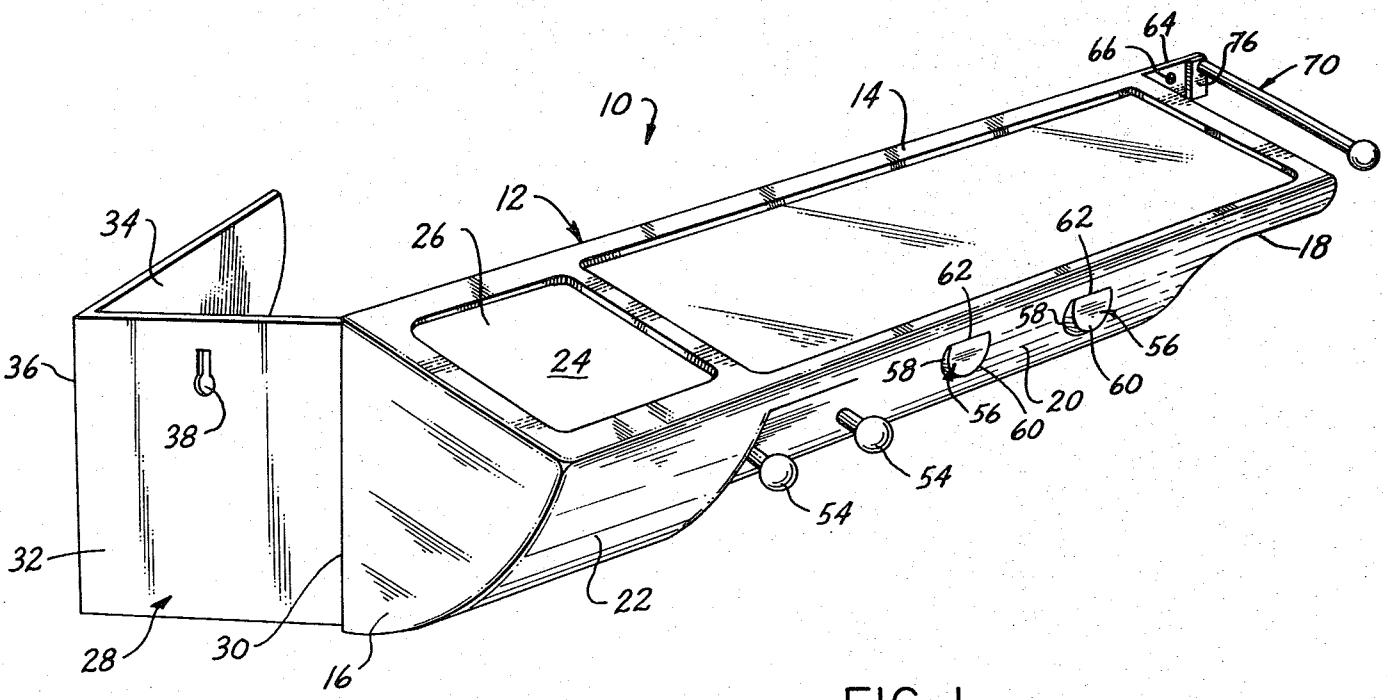
FIG. 1 is a perspective view of a shelf constructed in accordance with the present invention.
Figure 2:
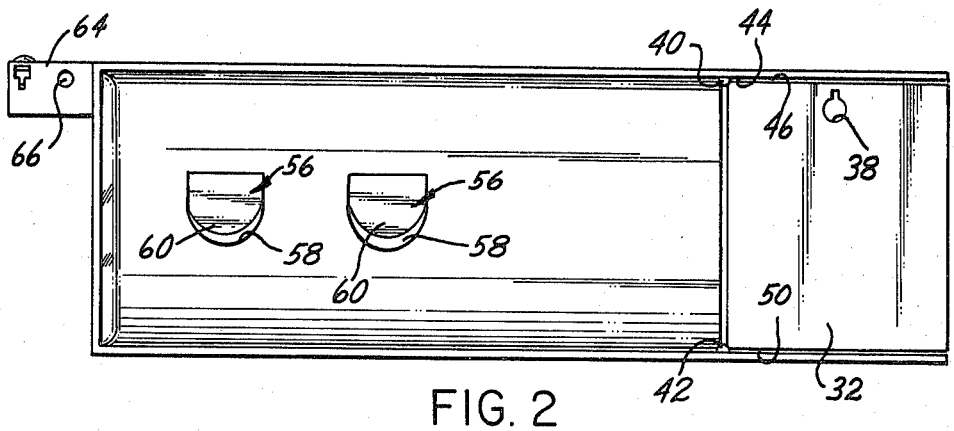
FIG. 2 is a rear elevational view of the shelf illustrated in FIG. 1 with its storage well panel in a closed position.
Figure 3:
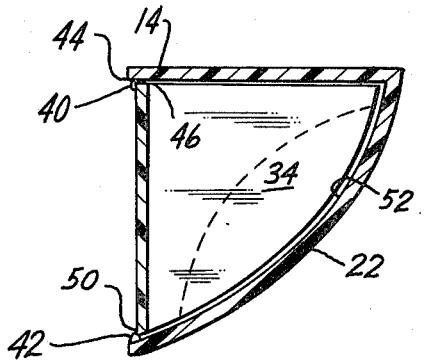
FIG. 3 is a cross-sectional view, taken along line I-I in FIG. 2 and looking in the direction of the arrows, of the shelf illustrated in FIG. 2.
Figure 4:
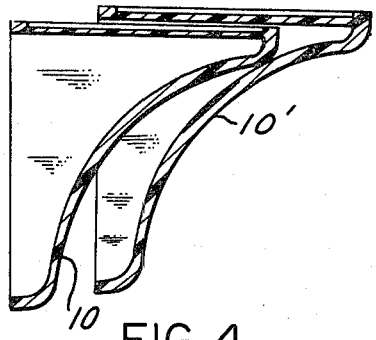
FIG. 4 is an exploded view of a portion of the shelf shown in FIG. 1.

Referring to FIGS. 1–4, there is shown a utility shelf 10, which includes a unitary body 12 defined by a substantially flat top wall 14, a pair of converging and diverging sidewalls 16, 18 and a curved front wall 20, having a bulged section 22. The top wall 14 is sized and shaped so as to receive a variety of different articles, such as deodorant cans, glasses, watches, wallets, etc. Because of its unitary construction, the body 12 may be monolithically molded from any suitable plastic material, such as polypropylene, in a single molding operation.

The body 12 also has an internal storage well 24 positioned adjacent to the sidewall 16. An opening 26 in the top wall 14 provides access to the storage well 24 from above, so that objects, such as combs and brushes, can be held in the storage well 24 in an upright position.

Figure 5:
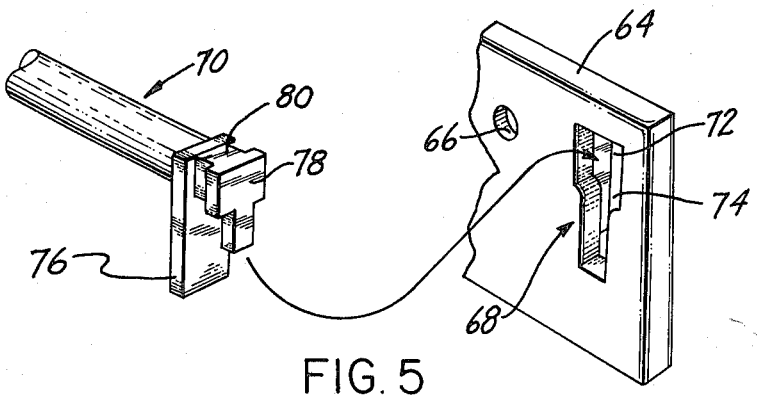
FIG. 5 is a view showing several shelves nested one inside the other.

A panel 28 is hingedly and integrally connected by a live hinge 30 to the sidewall 16 of the body 12 such that the panel 28 pivots between a closed position in which the panel 28 extends into the body 12 and an open position in which panel 28 is positioned outside the body 12. When the panel 28 is in its open position, the shelf 10 may be nested in another identical shelf 10' (see FIG. 5) to facilitate shipping and display of the shelves 10, 10'.

The panel 28 includes a first section 32, which is directly attached to the sidewall 16 of the body 12 by the live hinge 30, and a second section 34, which is hingedly and integrally connected to the first section 32 by a live hinge 36. When the panel is in its closed position, the first section 32 forms a rear wall of the storage well 24, while the second section 34 forms an inner sidewall of the storage well 24. An outer sidewall of the storage well 24 is defined by the sidewall 16 of the body 12. In addition to functioning as a portion of the front wall 20 of the body 12, the bulged section 22 also serves as a front wall of the storage well 24. The first section 32 of the panel 28 is provided with a mounting hole 38 adapted to receive a fastener (not shown), such as a screw, for attaching the shelf 10 to a wall or a similar support surface when the panel 28 is in its closed position.

The panel 28 is maintained in its closed position by a pair of nipples 40, 42. The nipple 40, which extends downwardly from an inner edge 44 of the top wall 14 of the body 12, releasably engages an upper edge 46 of the first section 32 of the panel 28. The nipple 42, which extends upwardly from a lower edge 48 of the front wall 20 of the body 12, releasably engages a lower edge 50 of the first section 32 of the panel 28. The second section 34 of the panel 28 is urged against an inner side 52 of the bulged section 22 by the live hinge 36 (see FIG. 3).

A plurality of hangers 54 extend outwardly from the front wall 20 of the body 12. Objects, such as clothing garments, can be hung from the hangers 54, which are integrally molded with the body 12.

The front wall 20 of the body 12 is also provided with gripping devices 56 for gripping towels and similar articles. Each of the gripping devices 56 includes an opening 58 provided in the front wall 20 and a flap 60 which is hingedly connected to the front wall 20 by a live hinge 62 such that the flap 60 is pivotable between a non-gripping position in which the flap 60 extends outwardly from the front wall 20 to a gripping position in which the flap 60 extends inwardly from the front wall 20. The live hinge 62 urges the flap 60 towards its non-gripping position, so that the flap 60 pinches an article which has been inserted through the opening 58 against the front wall 20 when the flap 60 is in its gripping position. Articles can be released from the gripping devices 56 by pushing the flaps 60 further into the body 12 of the shelf 10.

A tab 64 extends outwardly from the sidewall 18 of the body 12. The tab 64 includes a mounting hole 66 adapted to receive a fastener (not shown), such as a screw, for attaching the shelf 10 to a wall or a similar support surface. The tab 64 is also provided with an opening 68, which forms a receptacle for a removable hook 70, which can be used to hold various objects, such as a roll of toilet paper. More particularly, the opening 68 includes a generally T-shaped receiving station 72 and a generally T-shaped locking station 74 (see FIG. 2).

The hook 70 includes an apron 76 having a generally rectangular shape. The size and shape of the apron 76 is selected such that the apron 76 will cover the opening 68 in the tab 64, whereby the opening 68 is hidden from view from the front of the shelf 10. The apron 76 has a T-shaped plug 78 and a neck 80 which attaches the plug 78 to the apron 76 such that the plug 78 extends outwardly from the apron 76 in a direction opposite to that of the hook 70. The size and shape of the plug 78 and the neck 80 are selected such that they are compatible with the opening 68 in the tab 64. More particularly, the size and shape of the plug 78 and the neck 80 are such that the plug 78 can be snapped into the receiving station 72 of the opening 68 and then slid into the locking station 74.

The design and construction of the opening 68 and the hook 70 are described in greater detail in prior U.S. patent application Ser. No. 327,806, filed on Dec. 7, 1981, which is owned by the assignee of the present application. The specification of the prior application is incorporated herein by reference thereto.

It will be understood that the embodiment described herein is merely exemplary and that a person skilled in the art may make many variations and modifications without departing from the spirit and scope of the invention. All such modifications and variations are intended to be included within the scope of the invention as defined in the appending claims.

I claim:

1. A plastic utility shelf, comprising a body, having a substantially flat top wall, a curved front wall, a pair of converging and diverging sidewalls, a storage well positioned in said body below an opening provided in said top wall, and a panel hingedly connected to said body such that said panel is pivotable between a closed position in which said panel extends into said body to form a rear wall and an inner sidewall of said storage well and an open position in which said panel is positioned outside said body to provide substantially complete access to said body from behind, whereby said shelf may be nested in another similar shelf when said panel is in its open position.

2. A shelf according to claim 1, wherein said panel is formed integrally with said body.

3. A shelf according to claim 2, wherein said panel is hingedly attached to one of said converging and diverging sidewalls of said body.

4. A shelf according to claim 3, wherein said panel includes a first section which is hingedly attached to said one sidewall of said body and a second section which is hingedly attached to said first section.

5. A shelf according to claim 4, wherein said first section forms said rear wall of said storage well when said panel is in its closed position and said second section forms said inner sidewall of said storage well when said panel is in its closed position.

6. A shelf according to claim 4, wherein said body includes locking means for releasably locking said panel in its closed position.

7. A shelf according to claim 1, wherein said front wall of said body includes gripping means for releasably gripping an object, said gripping means including an opening in said front wall, a flap associated with said opening, and hinging means for hinging said flap to said front wall such that said flap is pivotable from a non-gripping position in which said flap extends outwardly from said front wall to a gripping position in which said flap extends inwardly from said front wall, said hinging means urging said flap towards its non-gripping position, whereby said flap pinches an article inserted through said opening against said front wall when said flap is in its gripping position.

8. A shelf according to claim 7, wherein said flap and said hinging means are formed integrally with said front wall of said body.

9. A shelf according to claim 8, wherein said hinging means is a live hinge.

10. A shelf according to claim 7, further comprising first hanging means extending outwardly from said front wall of said body for hanging articles from said front wall and second hanging means releasably attached to said body adjacent to one of said converging and diverging sidewalls for hanging articles alongside said body.

* * * * *